US011254150B2

(12) United States Patent
Kobayashi

(10) Patent No.: US 11,254,150 B2
(45) Date of Patent: Feb. 22, 2022

(54) ADJUSTING METHOD FOR PRINTING APPARATUS, AND PRINTING APPARATUS

(71) Applicant: SEIKO EPSON CORPORATION, Tokyo (JP)

(72) Inventor: Masaki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 16/885,578

(22) Filed: May 28, 2020

(65) Prior Publication Data

US 2020/0376864 A1 Dec. 3, 2020

(30) Foreign Application Priority Data

May 31, 2019 (JP) ..... JP2019-102210

(51) Int. Cl.
*B41J 15/16* (2006.01)
*B41J 11/00* (2006.01)
(Continued)

(52) U.S. Cl.
CPC ..... *B41J 15/16* (2013.01); *B41J 11/009* (2013.01); *B41J 11/0095* (2013.01); *B41J 11/46* (2013.01);
(Continued)

(58) Field of Classification Search
CPC ..... B41J 15/16; B41J 11/0095; B41J 11/46; B41J 11/009; B41J 2203/01;
(Continued)

(56) References Cited

U.S. PATENT DOCUMENTS 5,988,905 A * 11/1999 Abe ..... B41J 11/0095 101/288
2017/0282612 A1 10/2017 Takahashi et al.
(Continued)

FOREIGN PATENT DOCUMENTS

JP 2013-028445 A 2/2013
JP 2016-049721 A 4/2016

OTHER PUBLICATIONS

SC-F9300 Series User's guide pp. 120-127; Seiko Epson Corporation 2017.

*Primary Examiner* — Henok D Legesse
(74) *Attorney, Agent, or Firm* — Workman Nydegger

(57) ABSTRACT

An adjusting method for a printing apparatus includes a head configured onto perform printing on a medium, a winding shaft configured to wind thereon the transported medium, a shaft adjustment mechanism configured to adjust a position of the winding shaft, and a notification part configured to provide a notification, the method including a printing step for printing a scale onto the medium, a transporting step for transporting the scale to the winding shaft, an image-capturing step for image-capturing the scale, which is transported to the winding shaft, at two different locations of the medium in a direction along an axis of the winding shaft, a notification step for providing to the notification part a notification about a result based on a captured image of the scale, and an adjustment step for adjusting a position of the winding shaft in accordance with a result notified to the notification part.

6 Claims, 8 Drawing Sheets

(51) Int. Cl.
*B41J 11/46* (2006.01)
*B65H 23/195* (2006.01)
*B65H 23/032* (2006.01)

(52) U.S. Cl.
CPC ..... *B65H 23/0328* (2013.01); *B65H 23/195* (2013.01); *B41J 2203/01* (2020.08); *B65H 2553/42* (2013.01); *B65H 2801/15* (2013.01)

(58) Field of Classification Search
CPC ..... B65H 23/195; B65H 23/0328; B65H 2801/15; B65H 2553/42
See application file for complete search history.

(56) References Cited

U.S. PATENT DOCUMENTS

2018/0236794 A1* 8/2018 Mizuno ..... B41J 29/38
2018/0264855 A1* 9/2018 Iwanami ..... B41J 11/0095

* cited by examiner

ADJUSTING METHOD FOR PRINTING APPARATUS, AND PRINTING APPARATUS

The present application is based on, and claims priority from JP Application Serial Number 2019-102210, filed May 31, 2019, the disclosure of which is hereby incorporated by reference herein in its entirety.

BACKGROUND

1. Technical Field

The present disclosure relates to an adjusting method for a printing apparatus, and a printing apparatus.

2. Related Art

In the related art, printing apparatuses that print images, characters, and the like on a medium transported in a roll-to-roll manner are known. For example, JP-A-2016-49721 discloses a liquid discharge apparatus as a printing apparatus in which a winding part that unwinds a medium of a roll form and a winding part that winds up the medium into a roll form are attached to a common member for the purpose of improving the positional accuracy of the medium in the transport path of the medium.

Printing apparatuses require an adjustment of the transport path length along both ends of the medium in the width direction when assembling the printing apparatus or when correcting deformation due to changes from aging. However, since the adjustment of the transport path length has been visually performed by the operator, there is a risk of variations in results of the adjustment of the transport path length.

SUMMARY

In an adjusting method for a printing apparatus of this application, the printing apparatus includes a head configured to perform printing onto a medium, a transport part configured to transport the medium in a transport direction, a winding shaft configured to wind thereon the transported medium, a camera configured to image-capture the winding shaft, a shaft adjustment mechanism configured to adjust a position of the winding shaft, and a notification part configured to provide a notification about information, and the method includes a printing step for printing a measurement pattern onto the medium, a transporting step for transporting the measurement pattern to the winding shaft, an image-capturing step for image-capturing the measurement pattern, which is transported to the winding shaft, at two different locations of the medium in a direction along an axis of the winding shaft, a notification step for providing a notification about a result based on a captured image of the measurement pattern, and an adjustment step for adjusting a position of the winding shaft in accordance with the result of notification provided to the notification part.

The adjusting method for the printing apparatus includes a determining step for determining whether a position adjustment of the winding shaft is required. The notification step may preferably include providing a notification about a determination result obtained in the determining step.

In the adjusting method for the printing apparatus, the image-capturing may be repeatedly performed during implementation of the adjustment step, and the notification step may preferably include providing a notification when determination is made in the determining step that the position adjustment of the winding shaft is not required.

In the adjusting method for the printing apparatus, the image-capturing step may preferably include image-capturing the measurement pattern by moving the camera in the direction along the axis of the winding shaft.

In the adjusting method for the printing apparatus, the winding shaft may include a reference pattern that is parallel to the axis of the winding shaft, the printing step may preferably include printing the measurement pattern along both ends of the medium in a direction orthogonal to the transport direction, and the image-capturing step may preferably include capturing an image including the measurement pattern and the reference pattern.

A printing apparatus of this application includes a head configured to perform printing onto a medium, a transport part configured to transport the medium in a transport direction, a winding shaft configured to wind thereon the transported medium, a camera configured to image-capture the winding shaft, a shaft adjustment mechanism configured to adjust a position of the winding shaft, a notification part configured to provide a notification about information of the apparatus, and a control part configured to print a measurement pattern onto the medium, transport the measurement pattern to the winding shaft, image-capture the measurement pattern that is transported to the winding shaft at two different locations of the medium in a direction along an axis of the winding shaft, and determine whether a position adjustment of the winding shaft is required, based on a captured image of the measurement pattern.

DESCRIPTION OF EMBODIMENTS

Figure 1:
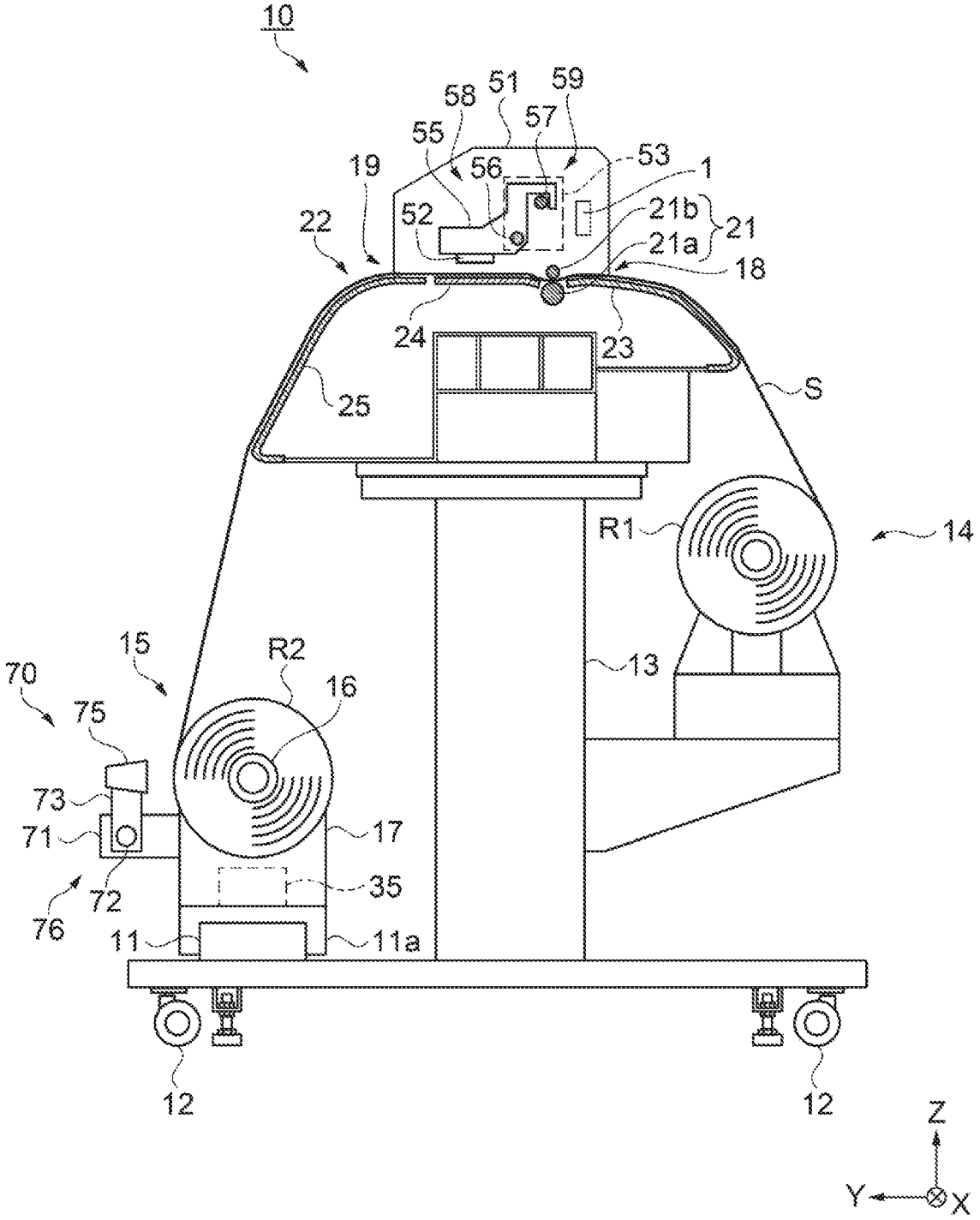
FIG. 1 is a sectional view illustrating a configuration of a printing apparatus according to a first embodiment in a normal printing operation.

Embodiments of the present disclosure will be described below with reference to the accompanying drawings. The following description is embodiments of the present disclosure and does not limit the disclosure. Note that, for illustration of elements and the like in recognizable sizes, the elements and the like illustrated in the drawings are not necessarily drawn to scale. In addition, in the coordinates illustrated in the drawings, both directions along the Z axis are the vertical direction with the arrow direction indicating the "upper" side, both directions along the X axis are the left-right direction with the arrow direction indicating the "left" side, both directions along the Y axis are the front-back direction with the arrow direction indicating the "front" side, and the X-Y plane is the "horizontal plane". In addition, both directions along the X axis correspond to the main scanning direction, and the Y axis corresponds to the transport direction in a printing part described later.

1. First Embodiment

A printing apparatus described in this embodiment is an ink jet-printer, for example. In the description of this embodiment, a large format printer (LFP) of a roll-to-roll type configured to handle a relatively large medium will be described as an exemplary configuration of the printing apparatus.

FIG. 1 is a sectional view illustrating a configuration of a printing apparatus according to the first embodiment in a normal printing operation. A configuration of a printing apparatus 10 will be described with reference to FIG. 1.

As illustrated in FIG. 1, the printing apparatus 10 includes a transport part 21, a medium supply part 14, a printing part 58, a medium winding part 15, and an image capturing part 70. The printing part 58 is provided in a substantially cuboid housing 51, which is long in the X axis direction and is supported by a frame 13 having a wheel 12 attached to the lower end thereof, and the transport part 21, the medium supply part 14, and the medium winding part 15 are coupled to the frame 13. In addition, the positional relationship along the transport direction of a medium S is also referred to as "upstream" or "downstream".

The medium supply part 14 is provided on the lower and back side of the housing 51 and supplies the medium S of a roll body R1 to the printing part 58. The roll body R1 composed of the unused medium S wound in a cylindrical form is held in the medium supply part 14. Note that roll bodies R1 of various sizes differing in number of turns and/or in width along the X-axis of the medium S are mounted to the medium supply part 14 in a replaceable manner. In addition, the roll body R1 is mounted to the medium supply part 14 such that the roll body R1 is aligned to the right end regardless of the size. Thus, by rotating the medium supply part 14 in which the roll body R1 is mounted, the medium S is unwound from the roll body R1 and fed to the printing part 58.

The medium winding part 15 is provided on the lower and front side of the housing 51 and winds up the medium S into a roll form. In the medium winding part 15, the medium S that has been printed at the printing part 58 is wound up into a cylindrical form so as to form a roll body R2. The medium winding part 15 includes a winding shaft 16 on which the medium S transported from the printing part 58 can be wound, and a pair of holders 17 that sandwich the winding shaft 16. One holder 17 is provided with a winding motor (not illustrated) that supplies rotary power to the winding shaft 16. When the winding motor is driven and the winding shaft 16 is rotated, the medium S is wound around the winding shaft 16 so as to form the roll body R2.

The holders 17 are fixed on a block 11*a* configured to be slidable with a base frame 11 extending along the X axis. In the pair of holders 17, winding shafts 16 differing in length are attached in accordance with the width of the medium S in a replaceable manner. Each holder 17 is provided with a shaft adjustment mechanism 35 for adjusting the position of the winding shaft 16 along the Z axis. The shaft adjustment mechanism 35 may be composed of a height adjustment bolt (not illustrated) that can adjust the height of the holder 17 with respect to the block 11*a* while maintaining the coupling between the block 11*a* and the holder 17. With the shaft adjustment mechanism 35 provided for each of the left and right holders 17, the heights of one end and the other end of the winding shaft 16 can be individually changed.

Note that the winding shaft 16 includes a core pipe on which the medium S is directly wound, flanges attached to both sides of the roll body R2, and a spindle coupled to the winding motor to transmit a rotational force to the core pipe. In addition, the medium winding part 15 may have a configuration including a tension roller that presses the back surface of the medium S hanging down under its own weight to apply tension to the medium S to be wound around the winding shaft 16.

The printing apparatus 10 includes an upstream guide part 23, a platen 24, and a downstream guide part 25, which constitute a portion of a transport path 22 of the medium S transported by the transport part 21. The upstream guide part 23 is provided upstream of the transport part 21 and guides, to the transport part 21, the medium S supplied from the medium supply part 14. The platen 24 is provided at a position facing the printing part 58 and supports the medium S facing the head 52. The downstream guide part 25 is provided downstream of the platen 24 and guides the printed medium S from the platen 24 to the medium winding part 15.

The transport part 21 transports the medium S in the transport direction. The transport part 21 extends along a direction intersecting the transport direction of the medium S and is provided between the platen 24 and the upstream guide part 23. The transport part 21 includes a transport driving roller 21*a* that is disposed on the lower side of the transport path 22 and is driven into rotation, and a transport driven roller 21*b* that is disposed on the upper side of the transport driving roller 21*a* and is rotated by the rotation of the transport driving roller 21*a*. The transport driven roller 21*b* is configured to be movable such that the transport driven roller 21*b* moves away from the transport driving roller 21*a* or is pressed against the transport driving roller 21*a*. In the state where the transport driving roller 21*a* and the transport driven roller 21*b* are pressed against each other, the transport part 21 feeds the medium S to the printing part 58 while sandwiching the medium S. In the housing 51, a transport motor (not illustrated) is provided as a power source that outputs rotational power to the transport driving roller 21*a*. When the transport motor is driven and the transport driving roller 21*a* is driven into rotation, the medium S sandwiched between the transport driven roller 21*b* and the transport driving roller 21*a* is transported in the transport direction.

An operation panel 62 is provided at an upper right portion of the housing 51. The operation panel 62 includes a display part 64 on which a printing condition setting screen or the like is displayed and an operation part 63 that is operated for inputting a printing condition and providing various instructions. The display part 64 also functions as a notification part 61 (see FIG. 2) described later. A container attaching part 66 (see FIG. 3) to which a liquid container 67 (see FIG. 3) that can contain liquid can be attached is provided at a lower right portion of the housing 51. A plurality of the liquid containers 67 are attached to the container attaching part 66 in accordance with the type and/or the color of the liquid. Further, a control part 1 configured to control the operation of each part of the printing apparatus 10 is provided in the housing 51.

The printing part 58 is provided inside the housing 51. In the back surface of the housing 51, a supplying port 18 for supplying the medium S to the printing part 58 is formed at a position on the upper side of the upstream guide part 23. In addition, in the front surface of the housing 51, an ejection port 19 for ejecting the medium S that has been printed at the printing part 58 is formed at a position on the upper side of the downstream guide part 25.

The printing part 58 is disposed above the position where the platen 24 is disposed, and performs printing on the medium S transported from the medium supply part 14. The printing part 58 includes a head 52 that discharges a liquid droplet to the medium S fed from the medium supply part 14 and transported to the platen 24 along the upstream guide part 23, a carriage 55 in which the head 52 is mounted, a head moving part 59 that moves the carriage 55 in a main scanning direction that intersects the transport direction.

The head moving part 59 moves the carriage 55 in the main scanning direction. The carriage 55 is supported by guide rails 56 and 57 disposed along the X axis, and is configured to be movable by the head moving part 59 back and forth in both directions along the X axis. As the mechanism of the head moving part 59, a mechanism including a combination of a ball screw and a ball nut, a linear guide mechanism, or the like may be employed, for example. Further, the head moving part 59 is provided with a motor (not illustrated) as a power source for moving the carriage 55 along the X axis direction. When the motor is driven under the control of the control part 1, the head 52 moves back and forth in both directions along the X axis direction together with the carriage 55.

An adjustment mechanism 53 that changes the position of the head 52 along the Z-axis for the purpose of adjusting the spacing between the head 52 and the platen 24 is provided on both end portions of the guide rails 56 and 57. The head 52 discharges the liquid supplied from the liquid container 67 as a liquid droplet to the medium S transported along the transport path 22, and thus printing is performed. The printed medium S is guided obliquely downward along the downstream guide part 25 and transported to the medium winding part 15.

The image capturing part 70 includes a camera 75 that can capture an image of the winding shaft 16, a camera support part 73 on which the camera 75 is mounted, a camera moving part 76 that moves the camera support part 73 in a direction along an axis CL (see FIG. 3) of the winding shaft 16. The camera 75 is provided at a position facing the winding shaft 16, and captures an image of the winding shaft 16 and the medium S transported to the winding shaft 16. The camera 75 includes a lens and an imaging element (not illustrated) that converts, into an electrical signal, incident light from the lens.

The camera support part 73 is supported by a guide rail 72 disposed between a pair of rail support parts 71 that are coupled to the left and right holders 17 and are extended forward such that the camera support part 73 is movable by the camera moving part 76 back and forth in both directions along the axis CL of the winding shaft 16. As the mechanism of the camera moving part 76, a mechanism including a combination of a ball screw and a ball nut, a linear guide mechanism, or the like may be employed, for example. Further, the camera moving part 76 is provided with a motor (not illustrated) as a power source for moving the camera support part 73 along the axis CL of the winding shaft 16. When the motor is driven under the control of the control part 1, the camera 75 moves in a direction along the axis CL of the winding shaft 16 together with the camera support part 73.

While the printing apparatus 10 of a serial-head type in which the head 52 is mounted in the carriage 55 that moves back and forth to discharge ink while moving in the width direction of the medium S is exemplified in the embodiment, the printing apparatus may be of a line-head type in which the head 52 extending in the width direction of the medium S is arranged and fixed. In addition, the printing apparatus 10 may have a configuration in which a heater for rapidly drying and fixing the liquid droplet to the medium S by heating the medium S is provided inside, or may have a configuration including a drying oven.

Figure 2:
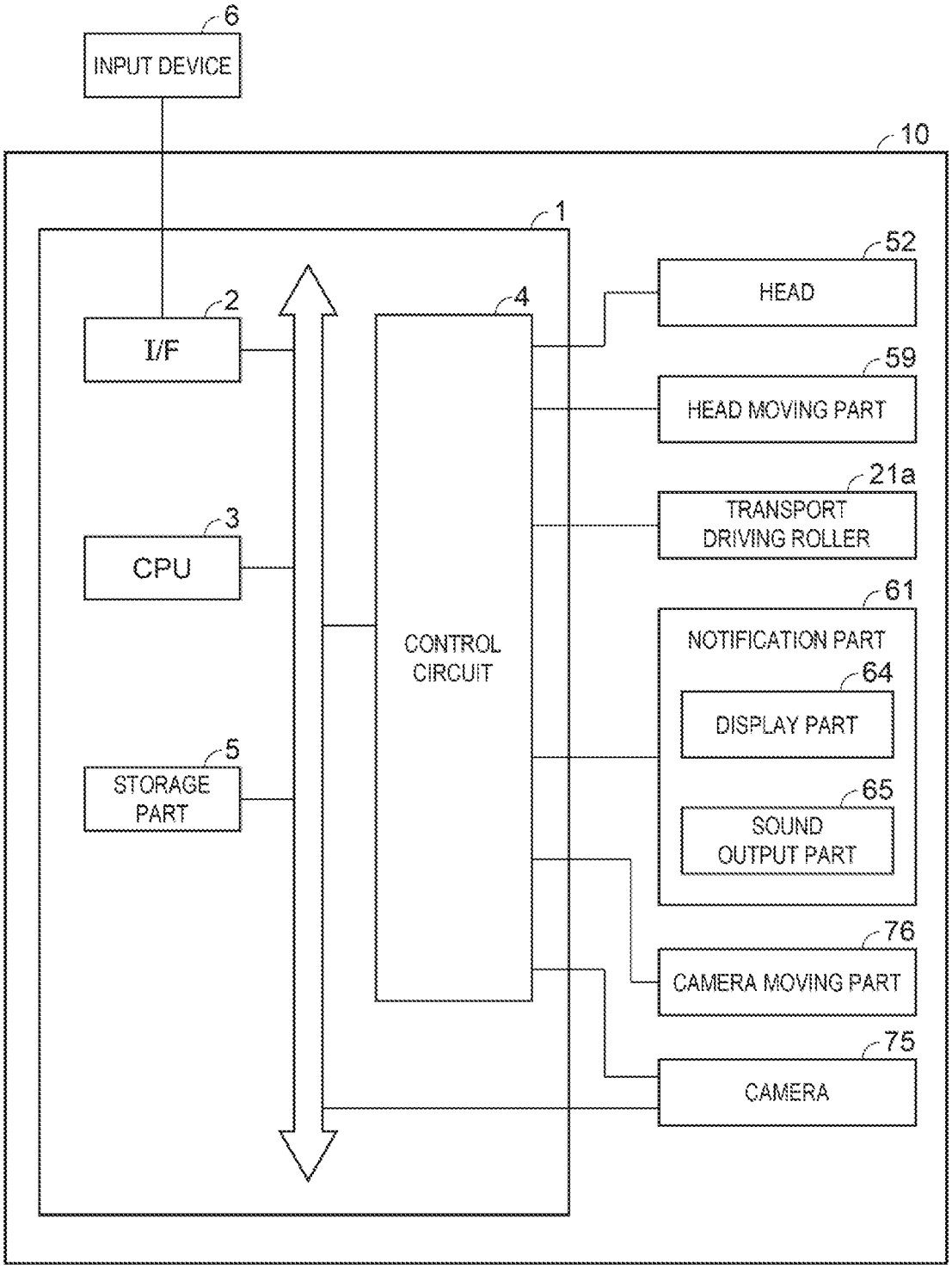
FIG. 2 is a block diagram illustrating an electrical coupling of the printing apparatus.

Next, an electrical configuration of the printing apparatus 10 will be described with reference to FIG. 2. FIG. 2 is a block diagram illustrating an electrical connection of the printing apparatus.

The printing apparatus 10 performs printing of images, characters and the like on the medium S on the basis of print data input from an input device 6. The input device 6 is a personal computer or the like, and may be configured to be provided in the housing 51 as in the printing apparatus 10. The input device 6 controls a job of causing the printing apparatus 10 to perform printing, and controls the printing apparatus 10 in coordination with the control part 1 of the printing apparatus 10. Software operated by the input device 6 includes commonly used image-processing application software for handling image data, and printer driver software for generating print data to cause the printing apparatus 10 to perform printing.

The printing apparatus 10 includes the control part 1 that controls each part provided in the printing apparatus 10. The control part 1 includes an interface part (I/F) 2, a CPU 3, a control circuit 4, and a storage part 5. The interface part 2, the storage part 5, and the control circuit 4 are electrically coupled to the CPU 3 through a bus.

The interface part 2 transmits and receives data between the control part 1 and the input device 6 for handling an input signal and/or an image. For example, the interface part 2 receives print data and the like generated by the input device 6.

The CPU 3 is an arithmetic processing device for performing various input signal processes, and an overall control of the printing apparatus 10 in accordance with a program stored in the storage part 5 and print data received from the input device 6.

The storage part 5 is a storage medium for ensuring a work area and an area for storing programs of the CPU 3 and the like, and includes a storage element such as a random access memory (RAM), an electrically erasable programmable read only memory (EEPROM), and the like.

The control circuit 4 is electrically coupled to the head 52, the head moving part 59, the transport driving roller 21*a*, the camera moving part 76, and the like. The control circuit 4 generates control signals for controlling the head 52, the head moving part 59, the transport driving roller 21*a*, the camera moving part 76, and the like on the basis of printing data and an arithmetic computation result of the CPU 3.

In addition, the control circuit 4 is electrically coupled to the camera 75. The camera 75 is electrically coupled to the CPU 3 through a bus. The control circuit 4 generates a control signal for controlling the camera 75. On the basis of a control signal generated by the control circuit 4, the camera 75 captures scales 31 and 32 (see FIG. 5) on the medium S transported to the winding shaft 16 (described later), converts the captured image into an electrical signal, and transmits the image to the CPU 3.

In addition, the control circuit 4 is electrically coupled to the notification part 61. In addition, the notification part 61 is configured to make a notification about information of the apparatus, and includes the display part 64 that displays images and characters, and a sound output part 65 that outputs sound. The control circuit 4 generates a control signal for making a notification at the notification part 61 about a result based on an image captured by the camera 75.

The control part 1 forms on the medium S a raster line of dots aligned along the X-axis by performing main scanning in which ink is discharged from the nozzle while moving the carriage 55 along the X-axis that is the main scanning direction on the basis of a control signal output from the control circuit 4. In addition, the control part 1 performs sub scanning in which the medium S is moved along the Y-axis that is the transport direction on the basis of a control signal output from the control circuit 4. By alternately performing the main scanning and sub scanning, a desired image based on the image data is recorded on the medium S.

Figure 3:
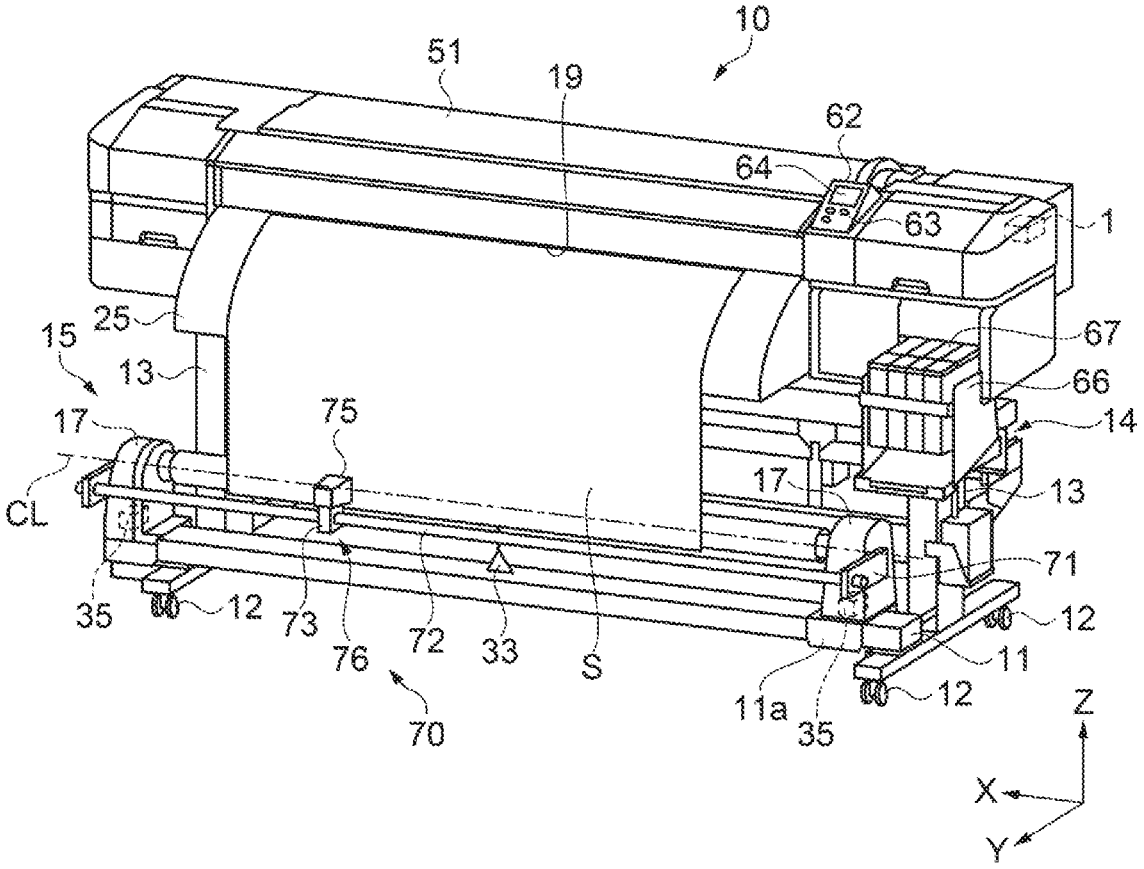
FIG. 3 is a perspective view schematically illustrating a configuration of the printing apparatus under adjustment.
Figure 4:
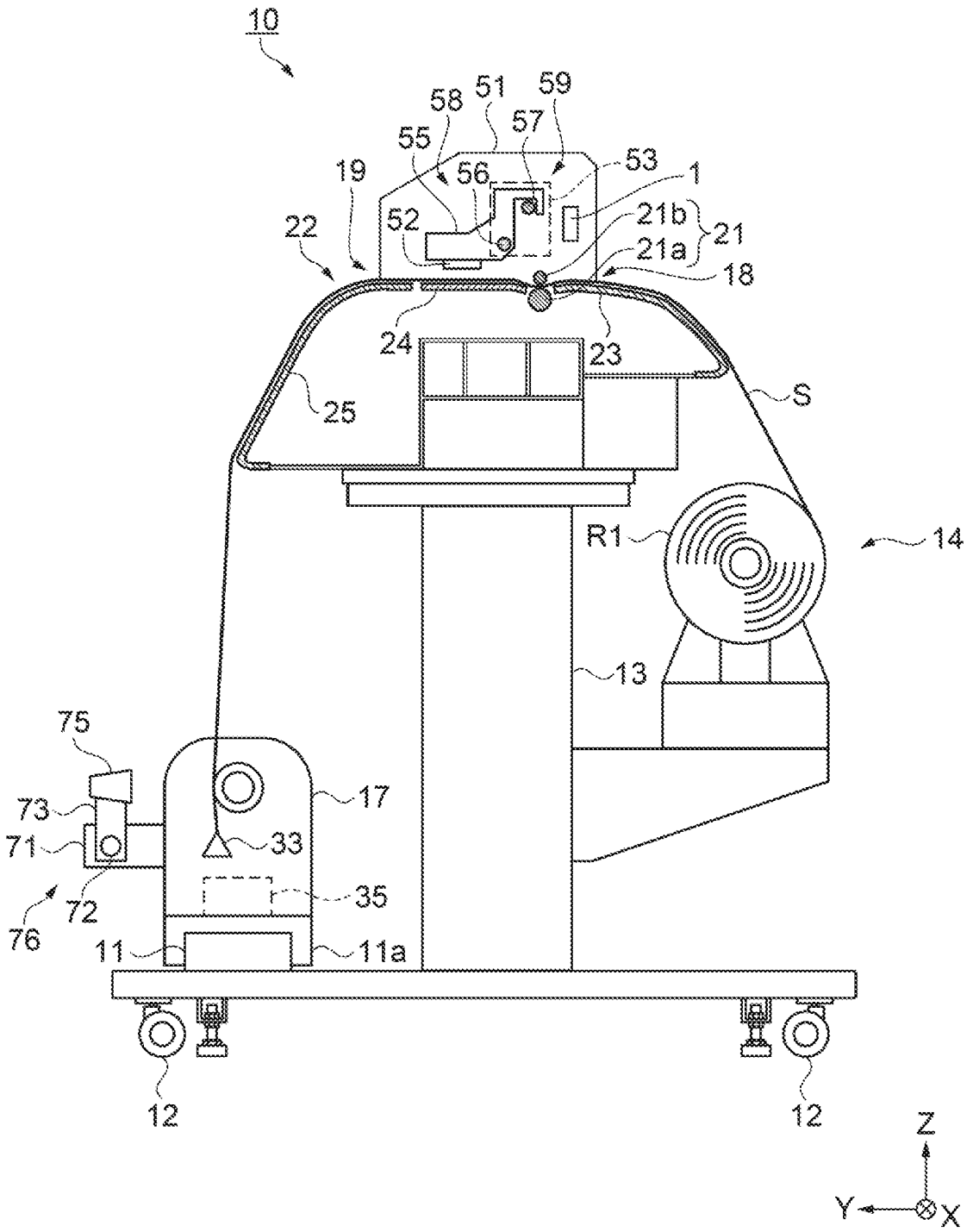
FIG. 4 is a cross-sectional view illustrating a configuration of the printing apparatus under adjustment.
Figure 5:
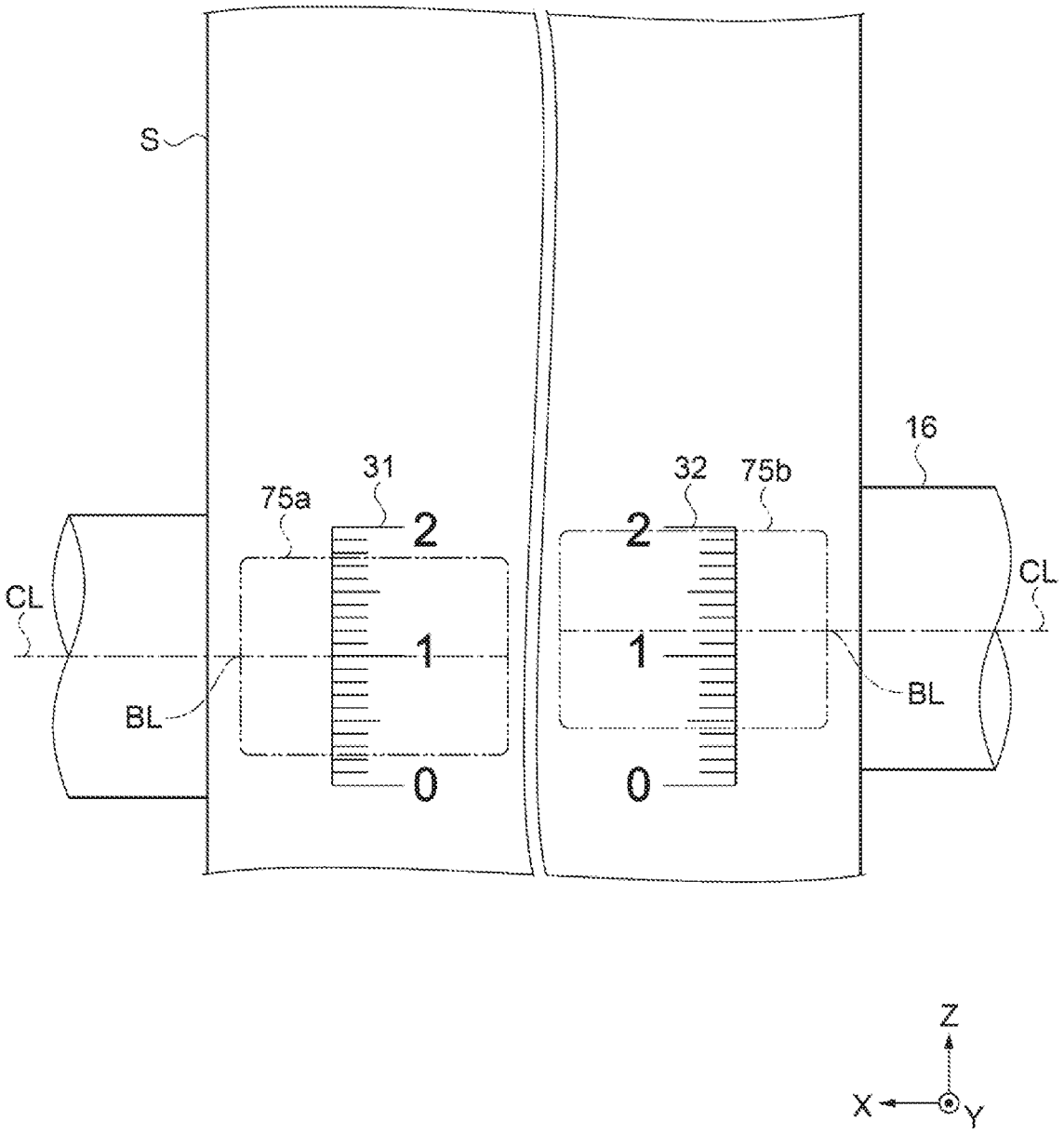
FIG. 5 is an enlarged view illustrating a measurement pattern at a winding part.
Figure 6:
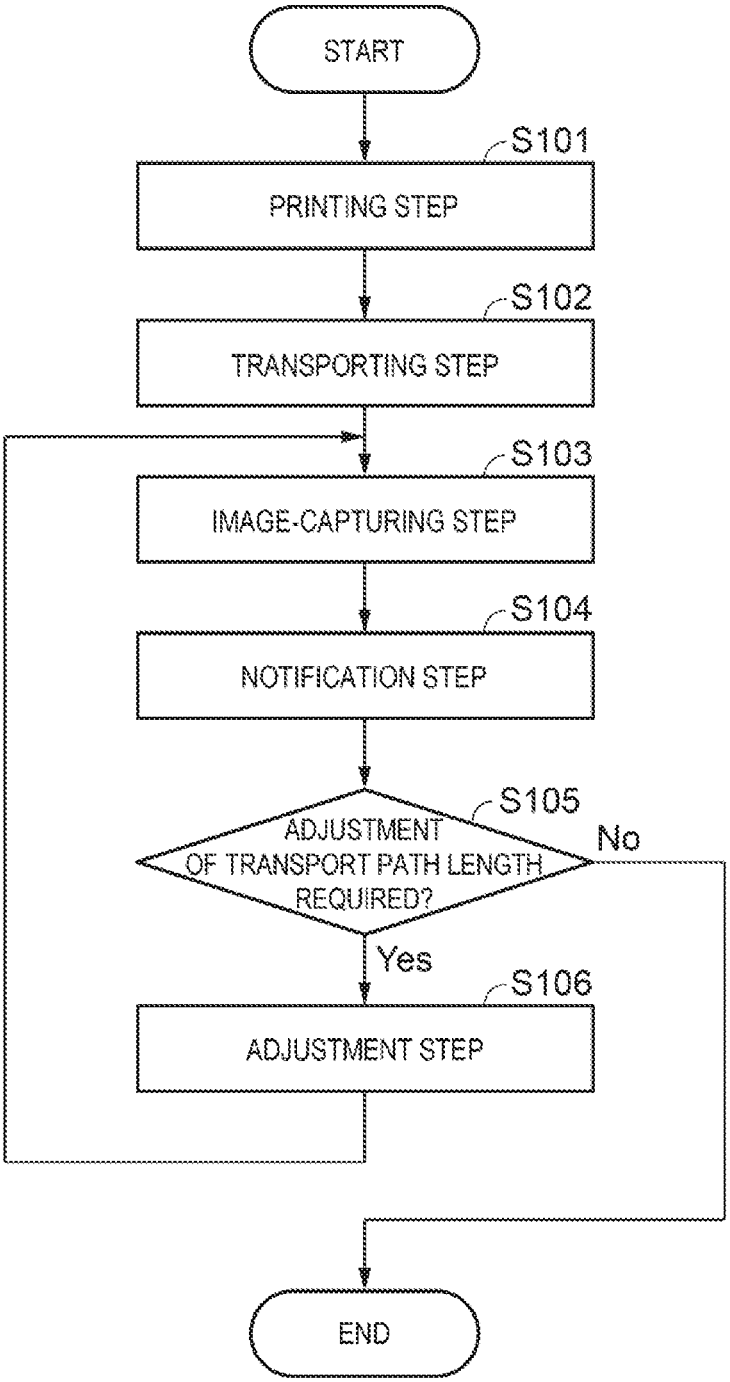
FIG. 6 is a flowchart illustrating a method of adjusting a transport path length.

Next, a method of adjusting the transport path length will be described with reference to FIGS. 3 to 6. FIG. 3 is a perspective view schematically illustrating a configuration of the printing apparatus under adjustment of the printing apparatus. FIG. 4 is a cross-sectional view illustrating a configuration of the printing apparatus under adjustment. FIG. 5 is an enlarged view illustrating a measurement pattern at the winding part. FIG. 6 is a flowchart illustrating a method of adjusting the transport path length. The adjustment of the transport path length is matching of the length of the medium transport path along the right end in the width direction of the medium S and the length of the medium transport path along the left end in the width direction of the medium S in the range from the platen 24 to the winding shaft 16. The adjustment of the transport path length can be achieved by changing the height of the winding shaft 16 by the shaft adjustment mechanism 35 provided in each of the left and right holders 17. In the following description, the length of the medium transport path along the right end of the medium S is referred to as "right transport path length", and the length of the medium transport path along the left end of the medium S is referred to as "left transport path length".

Step S101 is a printing step of printing a measurement pattern on the medium S. In this embodiment, the scales 31 and 32 are printed as a measurement pattern. The operator unwinds the medium S of the roll body R1 and passes the medium S from the supply port 18 to the ejection port 19. The control part 1 prints the scales 31 and 32 at two locations that are different from each other in the width direction of the medium S on the basis of the operation by the operator. A relatively hard and non-stretchable photographic paper and the like can be used as the medium S. While a configuration in which the scales 31 and 32 are printed at two different locations is described above, the scales 31 and 32 may be a wide scale printed in a wide range including two different locations. While a configuration in which the scales 31 and 32 are printed on the medium S as the measurement pattern is described above, the measurement pattern is not limited as long as the difference between the left and right transport path lengths can be determined.

Step S102 is a transporting step of transporting the scales 31 and 32 to the winding shaft 16. The control part 1 transports the printed scales 31 and 32 to the winding shaft 16. A material 33 is coupled to the front end of the medium S. Thus, tension is applied to the medium S, and slack of the medium S resulting from winding pattern or the like can be eliminated. The material of the material 33 is not particularly limited. In this embodiment, solid rubber having a mass of approximately 200 g is coupled.

Step S103 is an image-capturing step of capturing the scales 31 and 32 transported to the winding shaft 16 at two locations different from each other in the medium S in a direction along the axis CL of the winding shaft 16. The control part 1 captures an image range 75*a* including the scale 31 and an imaging range 75*b* including the scale 32 transported to the winding shaft 16 by moving the camera 75 along the guide rail 72 in a direction along the axis CL of the winding shaft 16. A reference line BL indicated in the imaging ranges 75*a* and 75*b* is a line parallel to the axis CL of the winding shaft 16, which is set in advance. While an exemplary configuration in which two different locations are captured by moving one camera 75 is described in this embodiment, it is also possible to employ a configuration in which two different locations are captured with two cameras provided and fixed at respective positions where the two locations can be captured. In this case, the adjustment time of the transport path length can be shortened since the two locations can be simultaneously captured.

Step S104 is a notification step of making a notification about a result based on captured images of the scales 31 and 32. The control part 1 generates an image in which the captured images of the scales 31 and 32 captured by the camera 75 in the imaging range 75*a* and the imaging range 75*b* are arranged, and notifies the image to the display part 64. Note that it is also possible to employ a configuration in which the control part 1 calculates the difference between the left transport path length and the right transport path length on the basis of the difference between the reference line BL and the scales 31 and 32 captured by the control part 1 in the imaging range 75*a* and the imaging range 75*b*, and then the control part 1 notifies the result to the display part 64.

Step S105 is a determination step in which the operator determines whether adjustment of the transport path length is required. For example, when the difference between the left transport path length and the right transport path length is greater than ±0.5 mm as a result of confirmation of the notification of step S104, the operator determines that adjustment of the transport path length is required (step S105: Yes), proceeds the process to step S106, and repeats the process from steps S103 to S105. When the difference between the left transport path length and the right transport path length is ±0.5 mm or smaller, the operator determines that adjustment of the transport path length is not required (step S105: No) and terminates this flow.

Step S106 is an adjustment step of adjusting the position of the winding shaft 16, i.e., an adjustment step of adjusting the transport path length in accordance with a result notified in the display part 64. The operator confirms a result notified in the display part 64 and operates at least one of the shaft adjustment mechanisms 35 provided on the left and right holders 17 to adjust the height of the winding shaft 16, and adjusts the difference between the left transport path length and the right transport path length to ±0.5 mm or smaller. Thus, the occurrence of winding deviation, wrinkles, and the like of the medium S wound around the winding shaft 16 can be suppressed.

As described above, the adjusting method for the printing apparatus 10 according to this embodiment can provide the following effects.

In the adjusting method for the printing apparatus 10, the medium S on which the scales 31 and 32 have been printed is transported to the winding shaft 16, and a notification about a result based on images captured at two locations in the medium S different from each other in a direction along the axis CL of the winding shaft 16 is made. The adjustment of the transport path length is performed by the shaft adjustment mechanism 35 provided in each of the left and right holders 17 on the basis of the notification result. After the adjustment of the transport path length, the imaging step and the notification step are performed, and the adjustment result of the transport path is displayed on the display part 64. Since the operator can confirm the adjustment result of the transport path length on the display part 64, variations in the adjustment results of the transport path length among operators can be suppressed.

The camera 75 is provided on the camera support part 73 and is moved together with the camera support part 73 along the guide rail 72 in a direction along the axis CL of the winding shaft 16. Thus, two different locations can be captured with one camera 75, and cost for providing the camera 75 can be saved.

2. Second Embodiment

Figure 7:
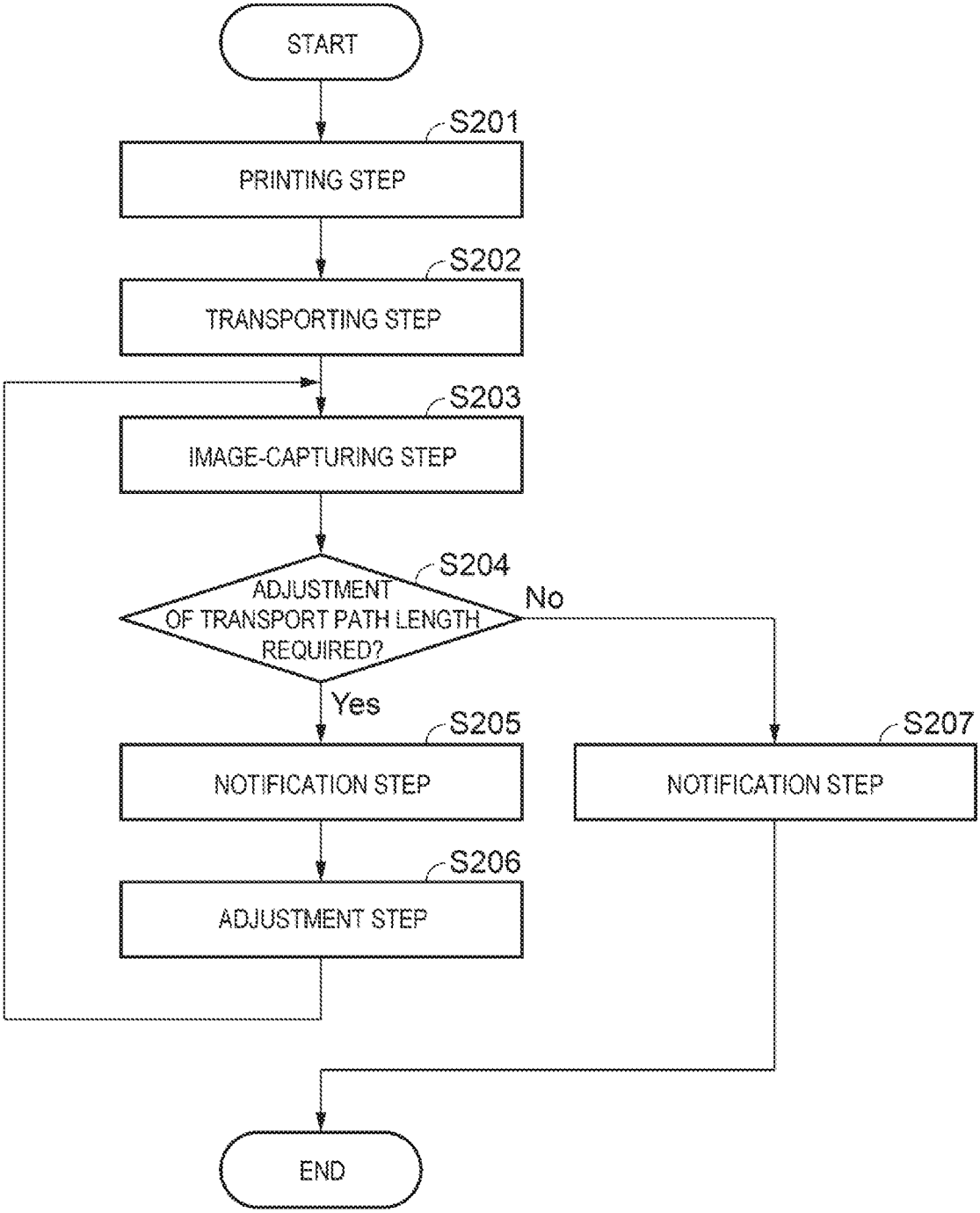
FIG. 7 is a flowchart illustrating a method of adjusting a transport path length according to a second embodiment.

FIG. 7 is a flowchart illustrating a method of adjusting the transport path length. Note that steps S201 to S203 are identical to the steps S101 to S103 described in the first embodiment, and therefore descriptions thereof will be omitted. In addition, the configuration of a printing apparatus according to a second embodiment is identical to the printing apparatus 10 described in the first embodiment, and therefore descriptions thereof will be omitted.

The CPU 3 of the control part 1 determines whether adjustment of the position of the winding shaft 16, i.e., the adjustment of the transport path length, is required on the basis of the captured image of the scales 31 and 32 captured at two different locations and printed on the medium S.

Step S204 is a determination step in which the control part 1 determines whether adjustment of the transport path length is required. The control part 1 calculates the difference between the left transport path length and the right transport path length on the basis of the difference between the reference line BL and the scales 31 and 32 captured in the imaging range 75*a* and the imaging range 75*b*. For example, when the difference between the left transport path length and the right transport path length is greater than ±0.5 mm, the control part 1 determines that adjustment of the transport path length is required (step S204: Yes), proceeds the process to steps S205 and S206, and repeats the process of steps S203 and S204. When the difference between the left transport path length and the right transport path length is not greater than ±0.5 mm, the control part 1 determines that adjustment of the transport path length is not required (step S204: No) and proceeds the process to step S207.

Step S205 is a notification step of making a notification about a determination result in the case where it is determined that adjustment of the transport path length is required. When the control part 1 determines that adjustment of the transport path length is required in step S204, the control part 1 makes a notification "adjustment value: right path+0.8 mm" to the display part 64. The operator can recognize that adjustment of the transport path length is required, and can recognize the adjustment value of the transport path length.

Step S206 is an adjustment step of adjusting the transport path length. The operator adjusts the height of the winding shaft 16 by operating at least one of the shaft adjustment mechanisms 35 provided on the left and right holders 17 on the basis of the result notified in the display part 64. This flow returns to the image-capturing step of step S203 without waiting for completion of the adjustment of the transport path length. The image-capturing step of step S203, the notification step of step S205, and the adjustment step of step S206 are repeated until it is determined that the adjustment of the transport path length is not required in the determination step of step S204.

Step S207 is a notification step of making a notification about a determination result in the case where it is determined that the adjustment of the transport path length is not required. When the control part 1 determines that the adjustment of the transport path length is not required in step S204, the control part 1 outputs, from the sound output part 65, a sound indicating that the adjustment of the transport path length has been completed, for example. In other words, the adjustment step of step S206 is continued until the operator recognizes the notification made in the notification step of step S207. For example, the control part 1 displays "adjustment completed" in the display part 64, and terminates the flow.

As described above, the printing apparatus 10 and the adjusting method for the printing apparatus 10 according to the second embodiment can provide the following effects.

The printing apparatus 10 includes the control part 1 that determines whether adjustment of the position of the winding shaft 16, i.e., the adjustment of the transport path length, is required, and the determination result is notified to the display part 64 and the sound output part 65. The operator performs adjustment in accordance with the notification, and thus variations in the adjustment results of the transport path length among operators are suppressed.

The adjusting method for the printing apparatus 10 includes the determination step in which the control part 1 determines whether adjustment of the transport path length is required, and the notification step of making a notification about the determination result of the determination step, and thus, the operator can easily recognize whether the adjustment of the transport path length has been correctly performed.

The adjusting method for the printing apparatus 10 includes the notification step of making a notification about the determination result in the case where it is determined that the adjustment of the transport path length is not required. Thus, the operator can continue the adjustment of the transport path length until the operator recognizes a sound notification indicating that it is determined that the adjustment is not required. The operator can complete the adjustment of the transport path length without confirming each notification in the display part 64.

Note that, the present disclosure is not limited to the embodiments described above, and various modifications and improvements can be added to the above-described embodiments. Modifications are described below.

3. Modifications

Figure 8:
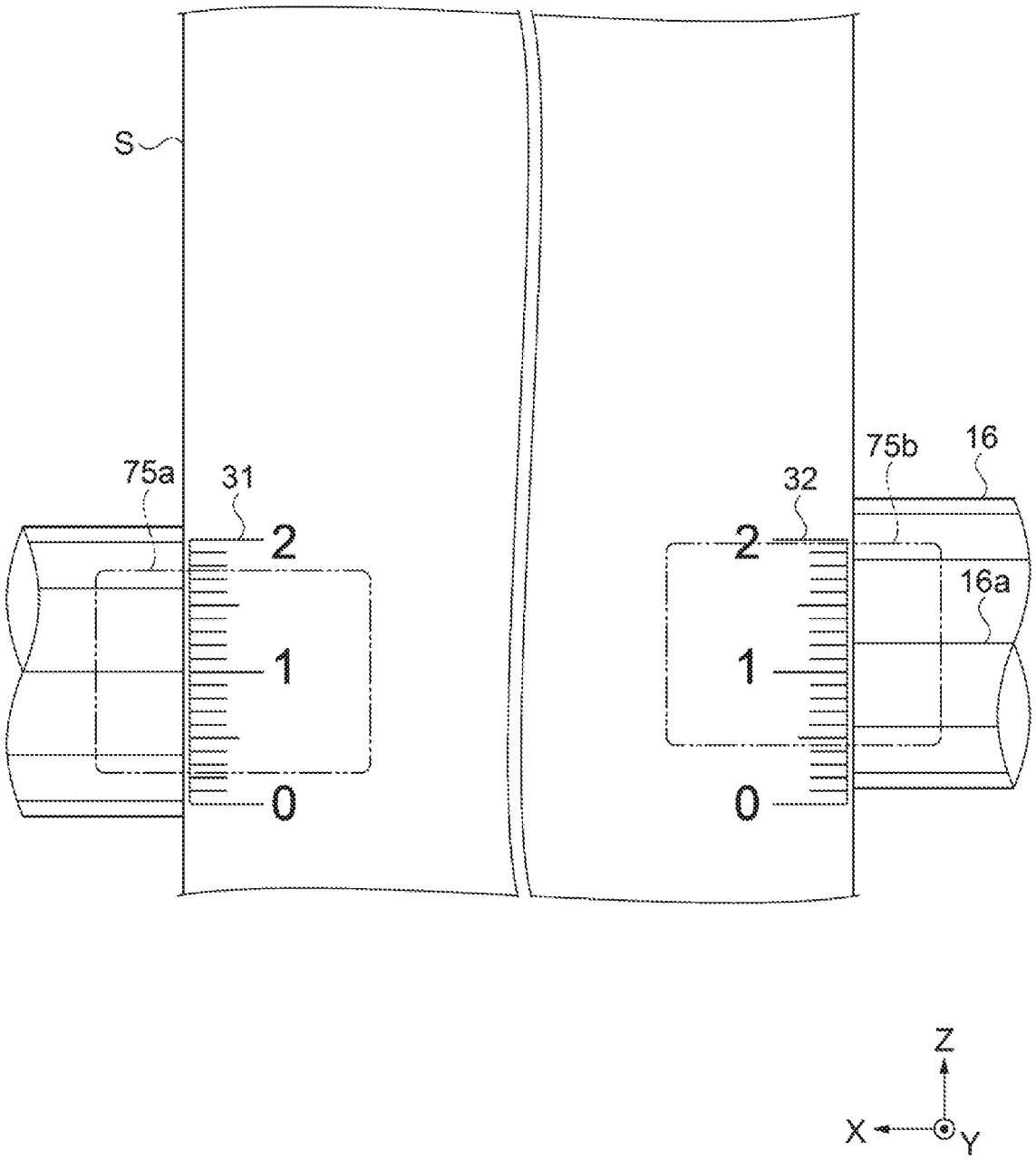
FIG. 8 is an enlarged view illustrating a measurement pattern at a winding part of a modification.

FIG. 8 is an enlarged view illustrating a measurement pattern of a winding part according to a modification.

The winding shaft 16 includes a reference pattern 16*a* that is parallel to the axis CL of the winding shaft 16. In the printing step, the scales 31 and 32 are printed along both ends of the medium S in the width direction of the medium S, which is a direction orthogonal to the transport direction. In the image-capturing step, the image range 75*a* including the reference pattern 16*a* and the scale 31 and the imaging range 75*b* including the reference pattern 16*a* and the scale 32 transported to the winding shaft 16 are captured. Thus, the displacement of the transport path length can be easily determined by comparing the positional relationship of the scales 31 and 32 with respect to the reference pattern 16*a* at both ends of the medium S.

In the first embodiment, the positions of the scales 31 and 32 with respect to the reference line BL in the imaging ranges 75*a* and 75*b* are determined, whereas, in the present modification, the positions of the scales 31 and 32 with respect to the reference pattern 16*a* of the winding shaft 16 are determined. Thus, it is not necessary to precisely match the parallelism between the reference line BL and the axis CL of the winding shaft 16, and therefore the camera 75 can be easily installed.

Contents derived from the embodiments will be described below.

In an adjusting method for a printing apparatus, the printing apparatus includes a head configured to perform printing onto a medium, a transport part configured to transport the medium in a transport direction, a winding shaft configured to wind thereon the transported medium, a camera configured to image-capture the winding shaft, a shaft adjustment mechanism configured to adjust a position of the winding shaft, and a notification part configured to provide a notification about information, and the method includes a printing step for printing a measurement pattern onto the medium, a transporting step for transporting the measurement pattern to the winding shaft, an image-capturing step for image-capturing the measurement pattern, which is transported to the winding shaft, at two different locations of the medium in a direction along an axis of the winding shaft, a notification step for providing a notification about a result based on a captured image of the measurement pattern, and an adjustment step for adjusting a position of the winding shaft in accordance with the result notified by the notification part.

According to this method, the notification part is notified of a result based on images of the measurement patterns that are printed on the medium and transported to the winding shaft together with the medium, and, captured at two different locations in a direction along the axis of the winding shaft. The transport path length of the medium is adjusted by the shaft adjustment mechanism of the winding shaft. A notification of the adjustment result can be made by capturing the measurement pattern after the adjustment of the transport path length. Since the operator can confirm the adjustment result of the transport path length in the notification part, variations in the adjustment results of the transport path length among operators can be suppressed.

The adjusting method for the printing apparatus includes a determining step for determining whether a position adjustment of the winding shaft is required. The notification step may preferably include providing a notification about a determination result obtained in the determining step.

According to this method, whether adjustment of the position of the winding shaft is required is determined in the determining, and thus the operator can easily recognize whether the adjustment of the transport path length has been correctly performed.

In the adjusting method for the printing apparatus, the image capturing step may be repeatedly performed during implementation of the adjustment step, and the notification step may preferably include providing a notification when determination is made in the determining step that position adjustment of the winding shaft is not required.

According to this method, the transport path length can be correctly adjusted by continuing the adjustment of the position of the winding shaft until the notification part notifies that the adjustment of the position of the winding shaft is not required.

In the adjusting method for the printing apparatus, the image-capturing step may preferably include image-capturing the measurement pattern by moving the camera in the direction along the axis of the winding shaft.

According to this method, two locations can be captured with one camera, and thus the cost for providing the camera can be saved.

In the adjusting method for the printing apparatus, the winding shaft may include a reference pattern that is parallel to the axis of the winding shaft, the printing step may preferably include printing the measurement pattern along both ends of the medium in a direction orthogonal to the transport direction, and the image-capturing step may preferably include capturing an image including the measurement pattern and the reference pattern.

According to this method, deviation of the transport path length can be easily determined by comparing the positional relationship of the measurement pattern with respect to the reference pattern at both ends of the medium.

A printing apparatus includes a head configured to perform printing onto a medium, a transport part configured to transport the medium in a transport direction, a winding shaft configured to wind thereon the medium transported, a camera configured to image-capture the winding shaft, a shaft adjustment mechanism configured to adjust a position of the winding shaft, a notification part configured to provide a notification about information of the apparatus, and a control part configured to print a measurement pattern onto the medium, transport the measurement pattern to the winding shaft, image-capture the measurement pattern that is transported to the winding shaft at two different locations of the medium in a direction along an axis of the winding shaft, and determine whether a position adjustment of the winding shaft is required, based on a captured image of the measurement pattern.

With this configuration, the control part determines whether adjustment of the position of the winding shaft is required on the basis of images of measurement patterns that are printed on the medium and transported to the winding shaft together with the medium, and, captured at two different locations in a direction along the axis of the winding shaft. The transport path length of the medium is adjusted by the shaft adjustment mechanism of the winding shaft. The control part makes a notification, to the notification part, about whether the transport path length has been correctly adjusted by capturing the measurement pattern after adjustment of the transport path length, and thus variations in the adjustment results of the transport path length among operators can be suppressed.

What is claimed is:

1. An adjusting method for a printing apparatus including a head configured to perform printing onto a medium, a transport part configured to transport the medium in a transport direction, a winding shaft configured to wind thereon the transported medium, a camera configured to image-capture the winding shaft, a shaft adjustment mechanism configured to adjust a position of the winding shaft, and a notification part configured to provide a notification about information, the method comprising:

a printing step for printing a measurement pattern onto the medium;

a transporting step for transporting the measurement pattern to the winding shaft;

an image-capturing step for image-capturing the measurement pattern, which is transported to the winding shaft, at two different locations of the medium in a direction along an axis of the winding shaft;

a notification step for providing a notification about a result based on a captured image of the measurement pattern; and an adjustment step for adjusting a position of the winding shaft in accordance with the result notified by the notification part.

2. The adjusting method for a printing apparatus according to claim 1, comprising a determining step for determining whether a position adjustment of the winding shaft is required, wherein the notification step includes providing a notification about a determination result obtained in the determining step.

3. The adjusting method for a printing apparatus according to claim 2, wherein the image-capturing is repeatedly performed during implementation of the adjustment step, and the notification step includes providing a notification when determination is made in the determining step that a position adjustment of the winding shaft is not required.

4. The adjusting method for a printing apparatus according to claim 1, wherein the image-capturing step includes image-capturing the measurement pattern by moving the camera in the direction along the axis of the winding shaft.

5. The adjusting method for a printing apparatus according to claim 1, wherein the winding shaft includes a reference pattern that is parallel to the axis of the winding shaft, the printing step includes printing the measurement pattern along both ends of the medium in a direction orthogonal to the transport direction, and the image-capturing step includes capturing an image including the measurement pattern and the reference pattern.

6. A printing apparatus comprising:

a head configured to perform printing onto a medium;

a transport part configured to transport the medium in a transport direction;

a winding shaft configured to wind thereon the transported medium;

a camera configured to image-capture the winding shaft;

a shaft adjustment mechanism configured to adjust a position of the winding shaft;

a notification part configured to provide a notification about information of the apparatus; and a control part configured to print a measurement pattern onto the medium, transport the measurement pattern to the winding shaft, image-capture the measurement pattern that is transported to the winding shaft at two different locations of the medium in a direction along an axis of the winding shaft, and determine whether a position adjustment of the winding shaft is required, based on a captured image of the measurement pattern.

* * * * *